US007486057B2

(12) United States Patent
Kosht et al.

(10) Patent No.: US 7,486,057 B2
(45) Date of Patent: Feb. 3, 2009

(54) ELECTRICAL REGULATOR HEALTH MONITOR CIRCUIT SYSTEMS AND METHODS

(75) Inventors: Danial L. Kosht, Gaylord, MI (US); Larry J. Terpstra, Central Lake, MI (US)

(73) Assignee: Honeywell International Inc., Morristown, NJ (US)

( * ) Notice: Subject to any disclaimer, the term of this patent is extended or adjusted under 35 U.S.C. 154(b) by 376 days.

(21) Appl. No.: 10/905,851

(22) Filed: Jan. 24, 2005

(65) Prior Publication Data

US 2006/0164052 A1 Jul. 27, 2006

(51) Int. Cl.
*G05F 1/40* (2006.01)

(52) U.S. Cl. ..... 323/272

(58) Field of Classification Search ..... 323/272, 323/282, 283, 284, 351
See application file for complete search history.

(56) References Cited

U.S. PATENT DOCUMENTS 3,978,393 A * 8/1976 Wisner et al. ..... 323/272
4,461,003 A * 7/1984 Tamaki ..... 714/22
4,611,162 A * 9/1986 Erratico et al. ..... 323/269
5,629,608 A * 5/1997 Budelman ..... 323/268
6,118,256 A 9/2000 Wilson
6,456,086 B1 * 9/2002 Bolz et al. ..... 324/522
6,580,261 B1 6/2003 Dow

FOREIGN PATENT DOCUMENTS

WO WO 2004064232 A2 * 7/2004

* cited by examiner

*Primary Examiner*—Adolf Berhane
(74) *Attorney, Agent, or Firm*—Ingrassia Fisher & Lorenz, P.C.

(57) ABSTRACT

Systems and methods for regulating input to a sensor. A circuit receives an unregulated voltage signal and a reduced version of the unregulated voltage signal. These signals are regulated by separate regulators then compared. If the difference between the two regulated signals is greater than a threshold amount then no voltage signal is sent to an attached sensor. If the difference between the two regulated signals is less than a threshold amount then a regulated voltage signal is sent to the sensor.

15 Claims, 3 Drawing Sheets

ELECTRICAL REGULATOR HEALTH MONITOR CIRCUIT SYSTEMS AND METHODS

BACKGROUND OF THE INVENTION

Typically, in highly sensitive sensing environments, such as an aircraft, redundant sensing devices, such as pressure sensors, wheatstone bridge sensors, or other sensors where output is a function of an input voltage, are provided for sensing the same signal. This is due mainly to certain inabilities to determine the effectiveness of the voltage regulator that is associated with each of the individual sensors. Failures of these sensors may occur due to simple supply voltage irregularities or (low voltage) from malfunction of their associated voltage regulators, such as regulator drift.

Therefore, there exists a need to improve the reliability of sensors, thereby reducing the need for a plurality of redundant sensors and associated complex voting algorithms.

SUMMARY OF THE INVENTION

An embodiment of the present invention is a circuit that detects the following failure modes:

Low input voltage supply that does not allow the regulators to function properly Regulator output drift (high or low)

Regulator failure (open or short circuit)

Wheatstone bridge open or short

Detection of these failure modes allows an end user to reduce the overall system complexity that would otherwise be required.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENT

Figure 1:
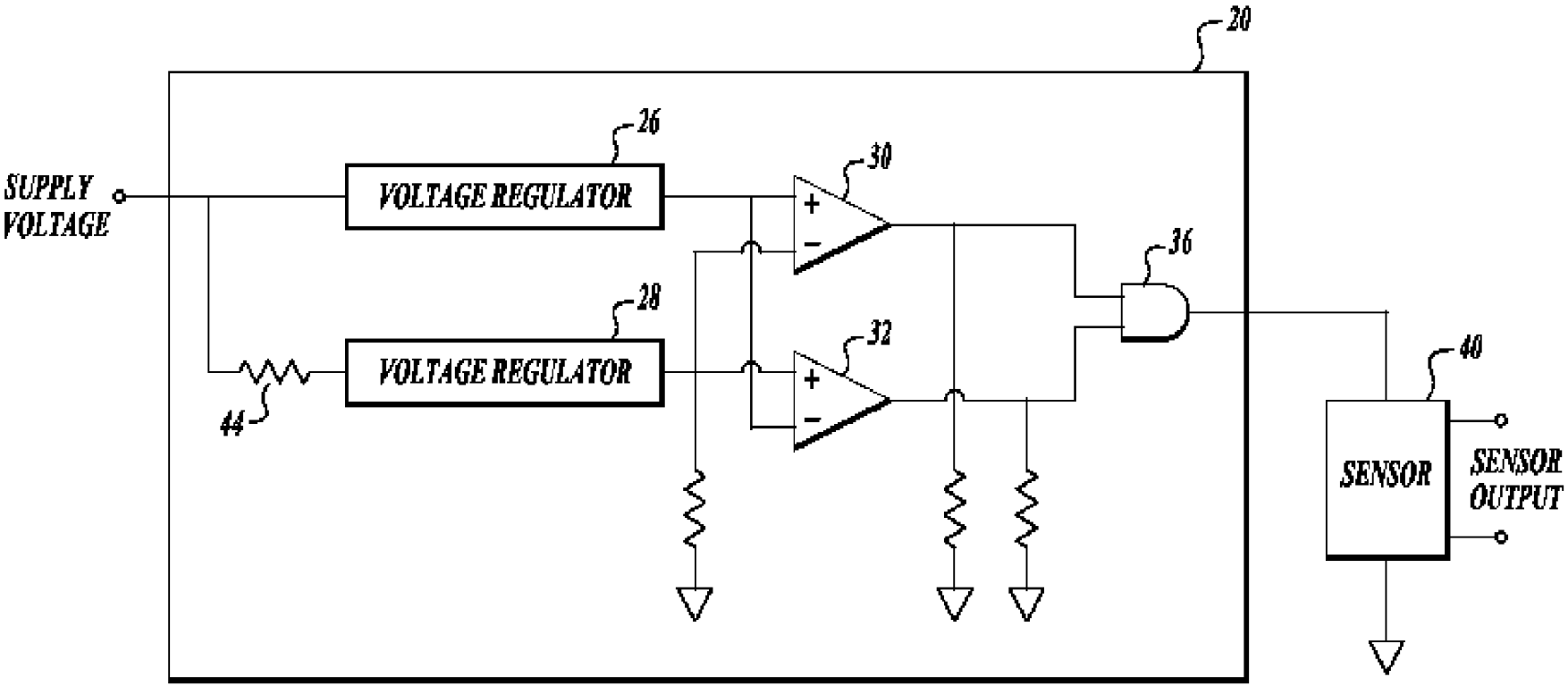
FIG. 1 is an example circuit formed in accordance with an embodiment of the present invention.

FIG. 1 illustrates an exemplary circuit 20 for determining quality of an input supply voltage and regulated voltage signals in order to determine the quality of the voltage signal input into a sensor. The circuit 20 includes a first and second regulator 26 and 28 first and second comparators 30 and 32 and an AND logic gate 36. The circuit 20 receives a supply voltage and performs an internal comparison scheme to ensure that the supply voltage does not differ by more than a few tenths of 1%. If the comparison proves to be positive, then the circuit 20 sends an input voltage to a sensor 40.

The supply voltage is received directly by the first voltage regulator 26 and passes through a first resistor 44 before it is received by the second regulator 28. The comparators 30 and 32 are essentially amplifiers configured as comparators. The first comparator 30 subtracts the output of the second regulator 28 from the output of the first regulator 26. The result of the comparator 30 is high if the difference between the two output regulator signals is below a threshold amount and is low if the difference is above the threshold amount. If the output of the comparator is high, the output of the comparator is the regulated voltage signal from the first regulator 26.

The second comparator 32 subtracts the output of the first regulator 26 from the output of the second regulator 28. Similar to comparator 30, the second comparator 32 outputs a high signal if the difference between the two signals is within a threshold amount and outputs a low signal if the difference between the two signals is greater than the threshold amount.

The outputs of the first and second comparators 30 and 32 are fed into the AND logic gate 36. The AND logic gate 36 supplies a voltage to the sensor 40 if the outputs of both comparators 30 and 32 are high ("on") i.e., the regulators 26 and 28 have the same or nearly the same output. If either or both of the voltage outputs of the first and second comparators 30 and 32 are low ("off"), then no voltage is supplied to the sensor 40.

When the outputs of both comparators 30 and 32 are high, the AND logic gate 36 outputs the voltage that supplies power to the gate 36. In one embodiment, the power to the gate 36 is supplied by the output of the first regulator 26.

The circuit 20 can detect when a low input voltage is supplied; one that does not allow the regulators 26 and 28 to function properly. The circuit 20 can also determine if there is drift in either one of the regulators 26 or 28 or failure of the regulators, such as an open or short circuit.

Figure 2:
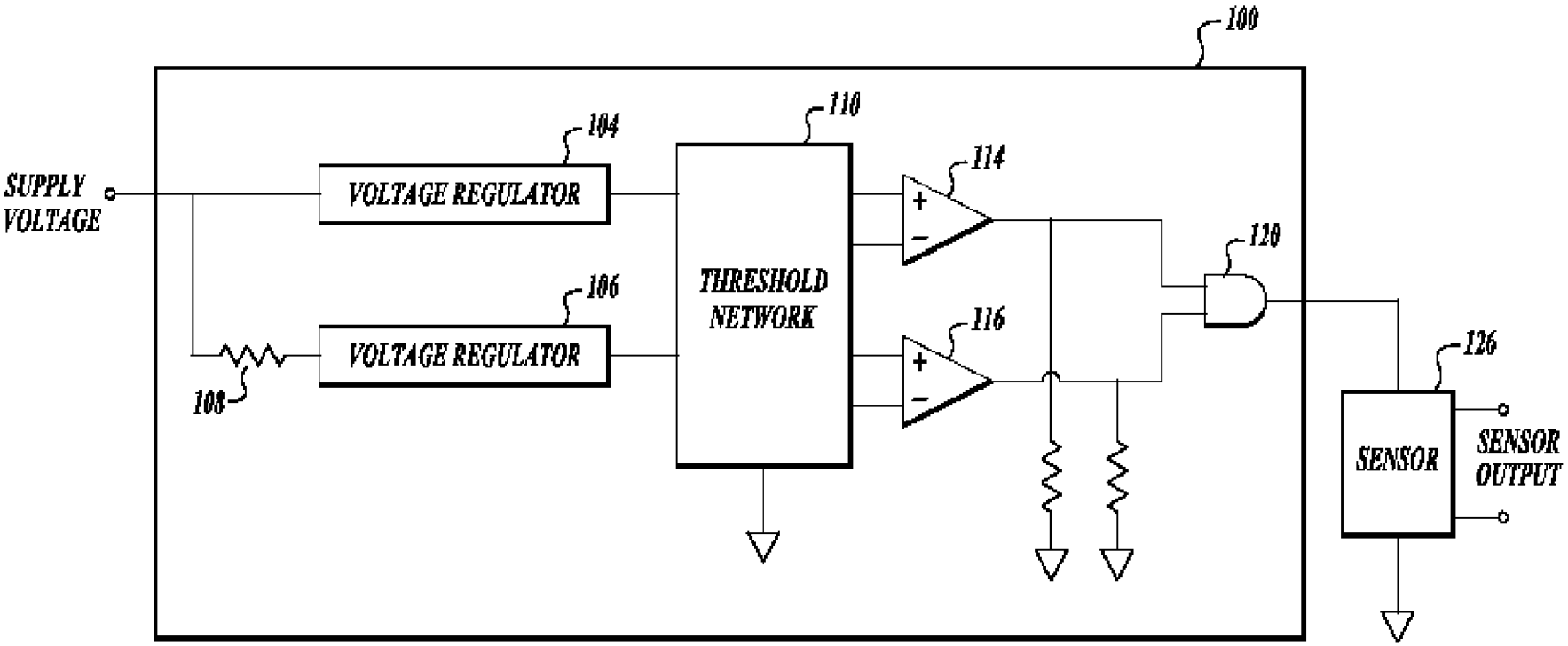
FIG. 2 is an alternate embodiment circuit of the present invention.

FIG. 2 illustrates another example circuit 100 formed in accordance with an embodiment of the present invention. Unregulated supply voltage is received by a first voltage regulator 104 and a second voltage regulator 106 via a resistor 108. The voltage regulated outputs of the voltage regulators 104 and 106 are sent through a threshold network 110.

The threshold network 110 allows for slight deviation of a couple of tenth of one percent to exist between the outputs of the regulators 104 and 106 without causing any slight deviation to flag a failure. This is done so that the tolerance on the regulators 104 and 106 does not have to be extremely high.

Figure 3:
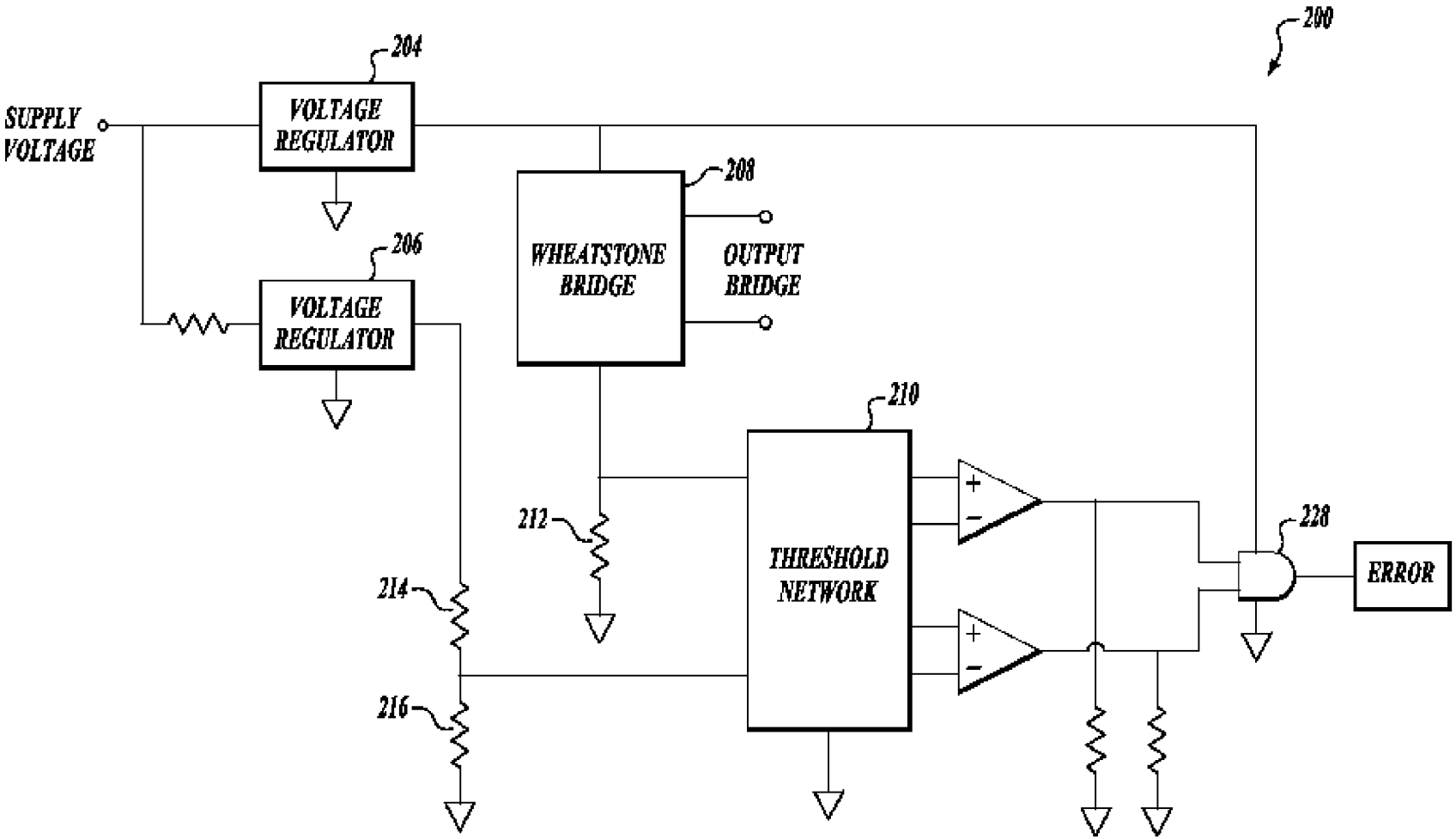
FIG. 3 is another alternate embodiment circuit of the present invention.

First and second comparators 114 and 116 compare the outputs of the threshold network 110. The comparators 114 and 116 produce high signals if the two regulator voltages that they receive match within a threshold voltage limit. If the compared regulator voltages differ by more than the threshold voltage limit, the comparators 114 and 116 produce a low signal. The outputs of the comparators 114 and 116 are entered into an AND logic gate 120. The AND logic gate 120 sends a regulated voltage signal to a sensor 124 if both comparators 114 and 116 produced high signals. FIG. 3 illustrates an alternate embodiment that includes additional circuitry for detecting large resistance changes in the sensing bridge. A resistor 212 is added in series after a sensing bridge 208, which is fed from a first regulator 204 to form a first voltage divider. Two resistors 214 and 216 are placed in series after a second regulator 206 to create a second voltage divider. The output of the first voltage divider is compared to the output of the second voltage divider created from the resistors 214 and 216 using circuits similar to that shown and described in FIGS. 1 and 2. If the sensing bridge 208 experiences a short, failure, or even a large change in magnitude, the voltage dividers will not match one another and an ERROR signal is set to lower zero. In normal operation, the ERROR signal is set to high or one.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The invention claimed is:

1. A regulator circuit for a sensor, comprising:

a first voltage regulator including a first output, the first voltage regulator configured to receive an unregulated supply voltage and output a first regulated voltage signal;

a resistor coupled to the first voltage regulator, the resistor configured to receive the unregulated supply voltage and to supply a reduced unregulated supply voltage;

a second voltage regulator including an input coupled to the resistor and a second output, the second voltage regulator configured to receive the reduced unregulated supply voltage and output a second regulated voltage signal;

a first comparator including a first positive input coupled to the first output and configured to receive the first regulated voltage signal, a first negative input configured to receive a reference voltage, and a third output, the first comparator configured to:

compare the first regulated voltage signal and the reference voltage, and generate a first output signal based on the comparison;

a second comparator including a second positive input coupled to the second output and configured to receive the second regulated voltage signal, a second negative input coupled to the first output and configured to receive the first regulated voltage signal, and a fourth output, the second comparator configured to:

compare the first and second regulated voltage signals, and generate a second output signal based on the comparison; and a component coupled to the third and fourth outputs and configured to be coupled to the sensor, the component configured to supply a regulated voltage to the sensor based on the first and second output signals.

2. The circuit of claim 1, wherein the first and second output signals are high signals if the difference between the first and second regulated voltage signals is less than a threshold limit.

3. The circuit of claim 1, wherein the component includes an AND logic gate.

4. A voltage regulator method for a sensor, the method comprising:

receiving an unregulated supply voltage at a first voltage regulator;

outputting a first regulated voltage signal from the first voltage regulator;

reducing the voltage of the unregulated supply voltage;

receiving the reduced unregulated supply voltage at a second voltage regulator;

outputting a second regulated voltage signal from the second voltage regulator;

comparing the first regulated voltage signal and a reference voltage to generate a first output signal;

comparing the first regulated voltage signal and the second regulated voltage signal to generate a second output signal; and supplying a regulated voltage to the sensor based on the first and second output signals.

5. The method of claim 4, wherein supplying includes:

supplying the regulated voltage to the sensor if a result of the comparison indicates that a difference between the first regulated voltage signal and the second regulated voltage signal is less than a threshold amount.

6. The circuit of claim 2, wherein the component further includes a threshold network configured to sense deviation between the first and second regulated voltage signals and flag a failure if the deviation is greater than a threshold amount.

7. A regulator circuit for a sensor, comprising:

a first voltage regulator including a first output, the first voltage regulator configured to receive an unregulated supply voltage and output a first regulated voltage signal;

a resistor coupled to the first voltage regulator, the resistor configured to receive the unregulated supply voltage and to supply a reduced unregulated supply voltage;

a second voltage regulator including a first input coupled to the resistor and a second output, the second voltage regulator configured to receive the reduced unregulated supply voltage and to output a second regulated voltage signal;

a first voltage divider coupled to the first output, the first voltage divider configured to receive the first regulated voltage signal and to produce a first signal;

a second voltage divider coupled to the second output, the second voltage divider configured to receive the second regulated voltage signal and to produce a second signal; and a component coupled to the first and second voltage dividers and configured to be coupled to the sensor, the component configured to supply a regulated voltage to the sensor based on the first and second signals.

8. The circuit of claim 7, wherein the component includes first and second comparators configured to compare the first and second signals and generate output signals according to the comparisons.

9. The circuit of claim 8, wherein the component further includes a threshold network configured to sense deviation between the first and second signals and flag a failure if the deviation is greater than a threshold amount.

10. The circuit of claim 8, wherein the output signals of the first and second comparators are high signals if the difference between the first and second signals is less than a threshold limit.

11. The circuit of claim 10, wherein the component includes an AND logic gate in communication with the first and second comparators.

12. The circuit of claim 7, wherein the first voltage divider includes a sensing bridge circuit.

13. A method, comprising:

receiving an unregulated supply voltage at a first voltage regulator;

outputting a first regulated voltage signal from the first voltage regulator;

reducing the voltage of the unregulated supply voltage;

receiving the reduced unregulated supply voltage at a second voltage regulator;

outputting a second regulated voltage signal from the second voltage regulator;

generating a first divider signal by applying the first regulated voltage signal to a first voltage divider;

generating a second divider signal by applying the second regulated voltage signal to a second voltage divider; and generating an error signal based on a comparison of the generated first and second divider signals.

14. The circuit of claim 7, wherein the first voltage divider includes a bridge sensor circuit coupled between the first voltage regulator and the component.

15. The method of claim 13, wherein generating includes:

comparing the first divider signal to the second divider signal; and generating a error signal if the result of the comparison indicates that a difference between the first divider signal and the second divider signal is less than a threshold amount.

* * * * *